US005417514A

United States Patent [19]

Korpi

[11] Patent Number: 5,417,514

[45] Date of Patent: May 23, 1995

[54] LANE MARKER

[75] Inventor: John G. Korpi, Livonia, Mich.

[73] Assignee: The United States of America as represented by the Secretary of the Army, Washington, D.C.

[21] Appl. No.: 183,412

[22] Filed: Jan. 18, 1994

[51] Int. Cl.[6] ..... E01F 9/01

[52] U.S. Cl. ..... 404/9; 116/63 P

[58] Field of Search ..... 404/6, 9, 10; 116/63 P, 116/63 R; 40/610, 612; 256/13.1

[56] References Cited

U.S. PATENT DOCUMENTS

| | | | |
|---|---|---|---|
| 3,933,118 | 1/1976 | Lyons et al. | 116/63 P |
| 4,394,843 | 7/1983 | Ediriwira | 116/63 P |
| 4,406,631 | 9/1983 | Dale | 441/30 |
| 4,848,263 | 7/1989 | Grimm | 116/63 P X |

*Primary Examiner*—Ramon S. Britts
*Assistant Examiner*—James A. Lisehora
*Attorney, Agent, or Firm*—Peter A. Taucher; David L. Kuhn

[57] ABSTRACT

The application describes an automatically deployable terrain marking device used to identify off-road safe-travel lanes for vehicles. The marking device has a base comprising a heavy ground engagement dish and a canister set on the ground engagement dish. The canister holds reagents of a foam formation system that can be triggered to form a expanding fluid foam that later hardens. A flexible inelastic base wall forms part of the base and mates to the ground engagement dish to form a sealed compartment containing the canister. A flexible tube frame assembly is communicated with the canister such that the tube frame assembly extends and expands during foam formation. The frame assembly thus has both a compact condition in which at least a part of the assembly folds upon a portion of the base and has an expanded condition in which the assembly is filled with hardened foam.

14 Claims, 5 Drawing Sheets

LANE MARKER

GOVERNMENT USE

The invention described herein may be manufactured, used and licensed by or for the U.S. Government for governmental purposes without payment to me of any royalty thereon.

BACKGROUND AND SUMMARY

At diverse times in the course of land warfare, it is necessary to mark certain geographic bounds or thoroughfares so that mines, traps and the like can be avoided. In recent times, markers have been deployed by automatic dispensers mounted on armored vehicles, whereby crews in the vehicles can accomplish boundary demarkation in relative safety. One problem in automatic marker deployment is that markers not only must occupy relatively small space envelopes while in the dispenser, but also must be relatively large and conspicuous once deployed. Another problem with such is a tendency to land upside down or on their sides, or after landing correctly, to later fall over or be knocked down.

I address the problem with my new self righting terrain or lane marker. The base of the lane marker comprises a rounded heavy ground engagement dish and a canister fixed on the dish. The canister holds a foam formation system that can form a fluid, expanding foam that inflates a light tubular frame assembly and then rigidifies. A flexible inelastic base wall forms part of the base and mates to the ground engagement member to form a sealed compartment containing the canister. The flexible tube frame assembly communicates with the compartment so that both the compartment and the frame assembly are filled by foam from the canister. The frame assembly has a compact state during which the assembly folds upon a portion of the base and also has an expanded state during which the assembly is filled with rigidifying foam. Due to the heaviness of the ground engagement member and the lightness of the frame assembly, the marker rights itself from a lying position to an upright position.

DETAILED DESCRIPTION

Figure 1:
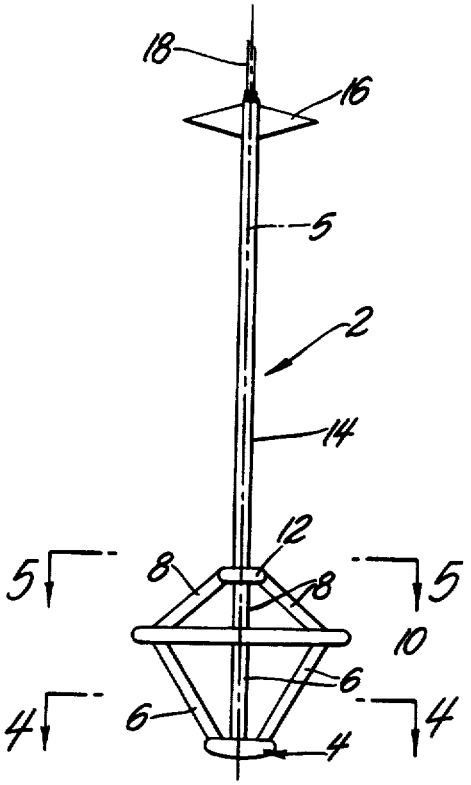
FIG. 1 is a front elevational view of my lane marker in a deployed condition with hidden lines omitted.
Figure 4:
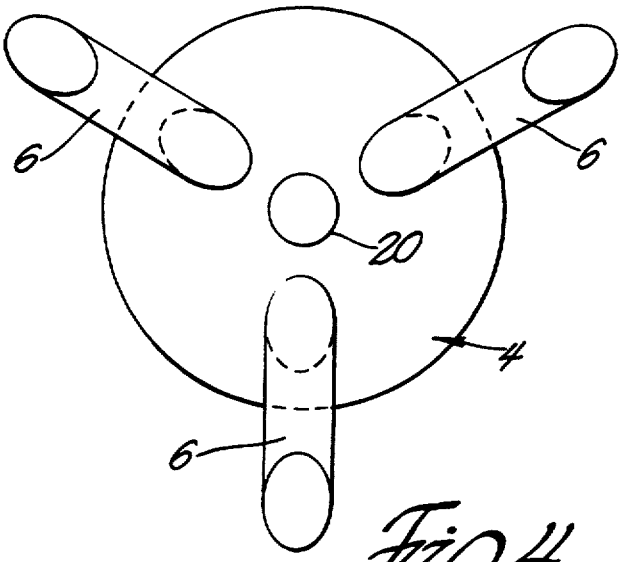
FIG. 4 is a view taken along line 4—4 in FIG. 1. Tube walls are shown as lines due to the thinness of these walls.
Figure 5:
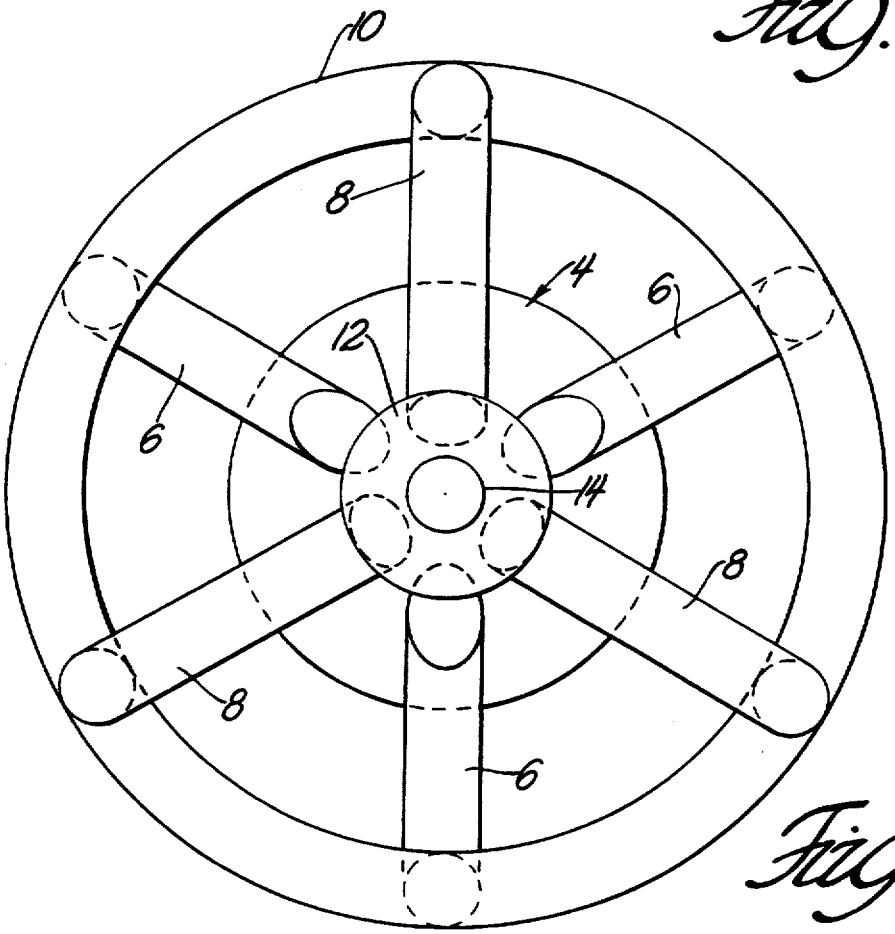
FIG. 5 is a view taken along line 5—5 in FIG. 1. Tube walls are again shown as lines due to the thinness of these walls.

In FIGS. 1, 4 and 5 is a first embodiment 2 of my lane marker having a ground engagement base 4 from which divergingly rise three equally angularly spaced lower tubes 6 in an array centered on the marker's central axis 5. Communicating with lower tubes 6 is a tubular ring 10 also centered on axis 5. Three upper tubes 8 communicate with the ring and converge toward flat, cylindrical manifold 12 concentric with axis 5. A central tubular strut 20 (FIG. 4 ) connects with and opens into both base 4 and manifold 12, and a tubular mast 14 opens to the manifold and extends upward therefrom. Atop mast 14 is a flag 16 and a conventional illuminator body 18.

Figure 6:
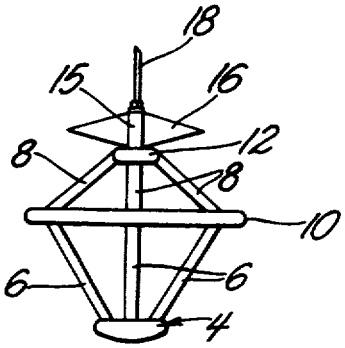
FIG. 6 is a front elevational view of an alternate embodiment of my lane marker in a deployed condition with hidden lines omitted.
Figure 17:
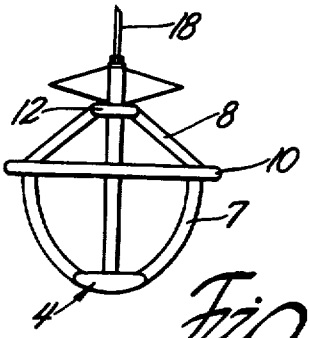
FIG. 17 is a front elevational view of a further alternate embodiment of the lane marker.

In FIG. 6 is a slight modification of The FIG. 1 embodiment wherein mast 14 is replaced by short upright tube 15. FIG. 17 shows a still further modification wherein the straight lower tubes 6 of FIG. 6 are replaced by outwardly bowed tubes 7 that will enhance the lane marker's self-righting capability, which is discussed later.

Figure 2:
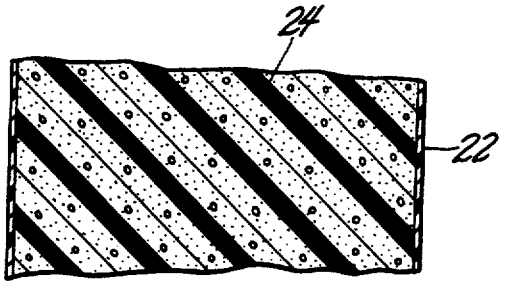
FIG. 2 is a typical cross section a of a foam filled tube of which my lane marker is comprised, the thickness of the wall tube being exaggerated for purposes of illustration.

FIG. 2 is a typical cross section of the tubular elements referenced above with respect to FIG. 1. The cross section includes a thin, flexible, essentially membranous or cuticular wall 22 normally made of a relatively inelastic rubber or plastic, the typical wall thickness being approximately 0.004 inches. Single-ply plastic sheeting commonly found in garbage can liners is an example of the kind of material suitable for wall 22. Inside wall 22 is expanding foam 24 that exerts outward fluid pressure on wall 22 during the foam's initial, fluid state, and wall 22 is under tension due to this pressure. The pressure causes the tubular members to inflate and extend into the FIG. 1 configuration, after which the foam cures and rigidifies. Such a foam is produced, for example by known polyurethane foam systems weighing 1 to 2 pounds per cubic foot and having a ratio of 30:1 or greater between the post-expansion and pre-expansion volumes of the system.

Figure 3:
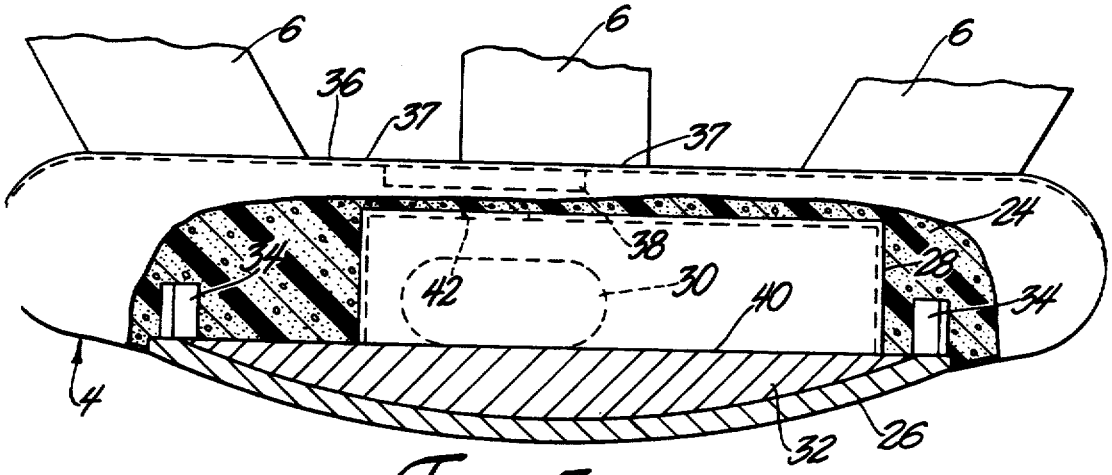
FIG. 3 is a partly sectioned detail view of one version of the base of the lane marker during the marker's deployed condition.
Figure 8:
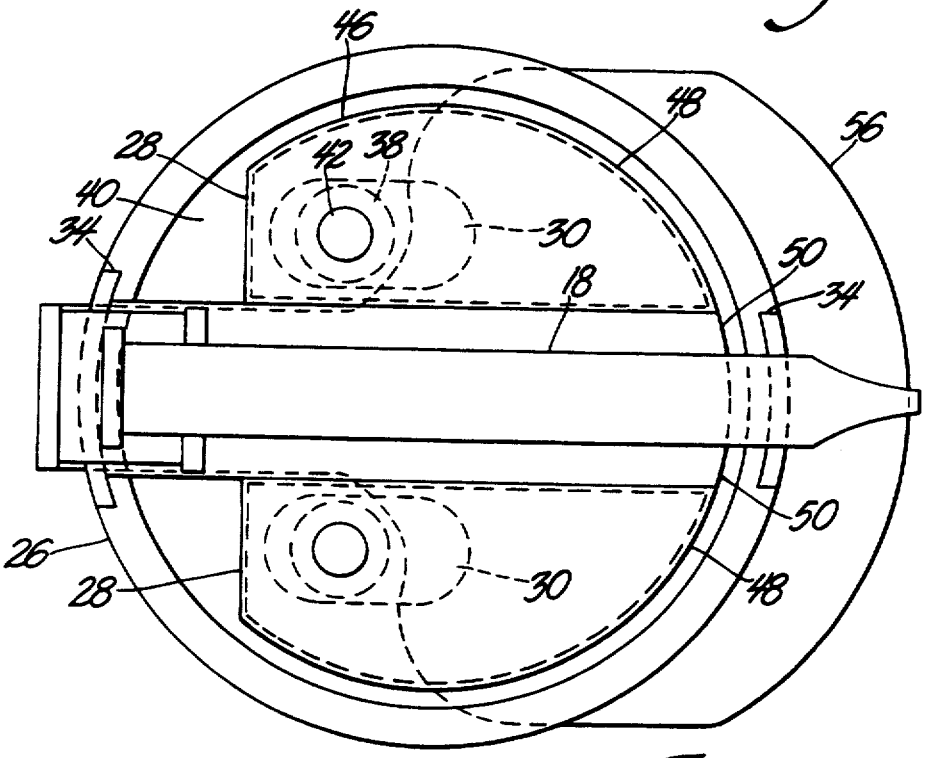
FIG. 8 is a top elevational view of my lane marker wherein the space envelope occupied by the folded tubes is represented by a dashed line.

FIG. 3 is a partly sectioned detail view of one design for the base and shows a shallow dish 26 of steel containing a weight or ballast 32. Instead of having ballast 32, dish 26 may be made thicker and heavier. With or without ballast 32, it is intended that the center of gravity of lane marker be within dish 26. Affixed to the dish are cradles 34 which support illuminated body 18 (as shown by FIG. 8) during the compact state of lane marker 2 before foam expansion. Fixed within base 4 are a pair of canisters 28, which contain foam formation reagents, one or more of which, depending on the foam system employed, may be segregated in frangible capsule 30 from a suitable resin or other material in the canisters. Directly above capsule 30 is a punch-out gap or orifice 42 through the outer peripheral wall of canister 28, the orifice being formed by a punching tool that pierces the canister and breaks capsule 30 just prior to deployment of lane marker 2. The portion of the canister's peripheral wall surrounding orifice 42 may be weakened, as by partial cutting, to facilitate hole formation by the punch. Directly above orifice 42 is filler plug 38, that enters and seals a rupture in base wall section 36 formed by the punch, plug 38 inhibiting or preventing exodus of expanding foam from base 4. Wall section 36 is preferably stronger and thicker than the typical wall 22 shown in FIG. 2, at least in the zone 37 adjacent plug 38.

Figure 9:
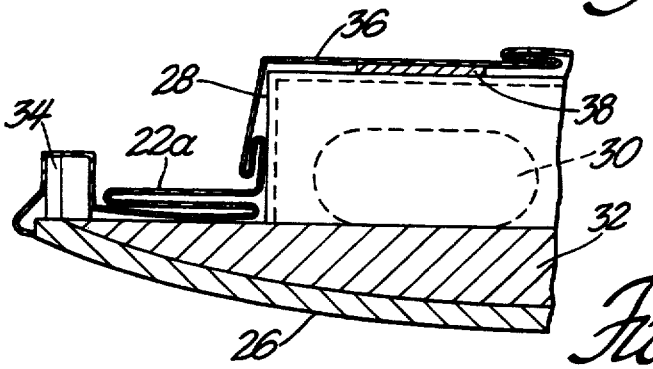
FIG. 9 is a partial sectional side view of the FIG. 3 base when the tubes are in a folded condition.

FIG. 9 illustrates one manner in which wall section 36 and adjoining peripheral wall section 22*a* are disposed in flat convoluted folds or tucks upon ballast 32, posts 34 and canister 36 before foam fills base 4. Section 22*a* is similar in structure to membranous wall 22 in FIG. 2.

Figure 7:
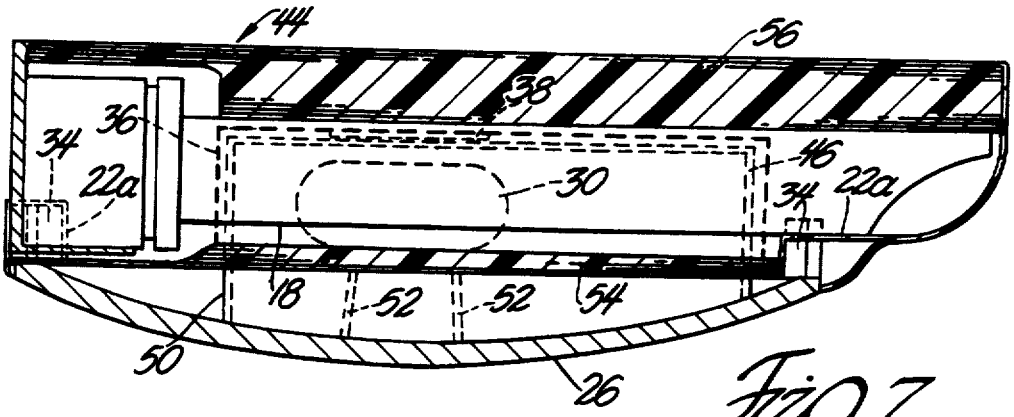
FIG. 7 is a partially sectioned view of my lane marker wherein the tubes are in an uninflated, folded configuration and wherein the base is different than that shown in FIG. 3.

Referring now to FIG. 7, an alternate embodiment 44 of the lane marker is shown having dish 26 and an integrated canister 46 thereon. Canister 46 has two opposed upper sections 48 similar in shape to canisters 28 in FIG. 3, and has canister well 50 located below sections 48 and connected therebetween. Within canister 46 are optional capsules 30 disposed immediately below filler plugs 38 and spaced from dish 28 by posts 52. A plan view of canister 46 is shown in FIG. 8.

Referring again to FIG. 7, opposed cradles 34 are affixed to the edge of dish 26 and flexible illuminator body 18 is supported on the cradles. A tube frame assembly comprised of tubes 6, tubes 8, ring 10, manifold 12, mast 14, and strut 20 is folded into space envelopes schematically represented by darkened areas in FIG. 7 at 54 and 56 while wall sections 36 and 22*a* of the base peripheral wall are folded upon canister 46 and posts 34. A plan view of envelope 56 is represented by dashed lines in FIG. 8. If the thinness of the walls of the tube frame assembly is similar to thinness of wall 22 in FIG. 2, the tube frame assembly can optionally be fit into envelope 54 alone.

Figure 10:
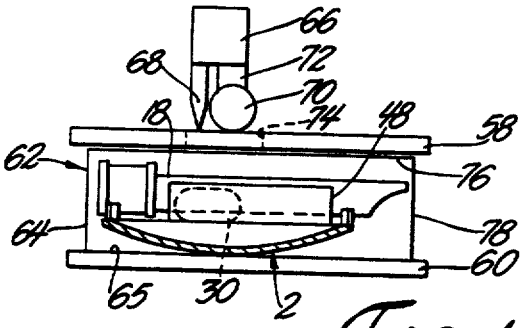
FIGS. 10 through 12 are a series of partly sectioned side elevational views showing activation of the light stick and the foam formation system in the lane marker.
Figure 13:
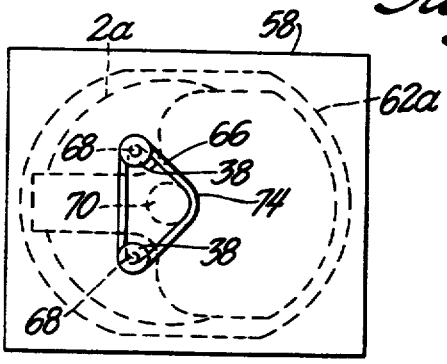
FIG. 13 is a top elevational view of the upper of two platens between which the lane marker is disposed during activation of the light stick and the foam formation system.

FIGS. 10 and 13 show a mechanism for preparing lane marker 2 for deployment wherein the marker is enclosed within container 62 between an upper platen 58 and a lower platen 60, the platens being fixed relative to one another. In FIG. 10 lane marker 2 and container 62 are shown in partial section, the tube frame assembly being omitted for convenience and the thin peripheral walls 64 of the container being represented by single lines. FIG. 13 is a plan view showing platen 58 wherein outlines of lane marker 2 and container 62 are represented by dashed lines 2*a* and 62*a*, respectively. A reciprocating tool 66 has teeth 68 and a spherical head 70 mounted on neck 72, the tool being mounted directly over triangular aperture 74 in platen 58.

Figure 14:
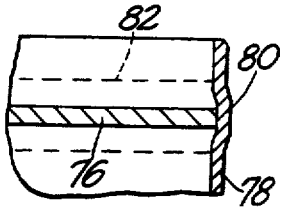
FIG. 14 is a sectional detail view of the engagement of a canister lid with a canister cup in which the lane marker is contained prior to deployment.
Figure 15:
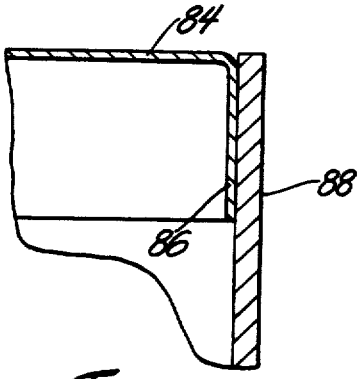
FIG. 15 is a sectional detail view of an alternate engagement of a canister lid with a canister cup.

In FIG. 14 is shown a partial sectional detail view of one embodiment of the interface between lid 76 of container 62 and container sidewall 78. Wall 78 has a slight arcuate bend 80 at the juncture with lid 76, the arcuate bend forming a somewhat annular band 82 about container 62. Lid 76 is in interference contact with wall 78 and easily deformable by a downward stroke of head 70, so that the downward stroke of tool 66 separates lid 76 from the container. Another design of the lid-sidewall interface is shown in FIG. 15, wherein lid 76 is replaced by a relatively heavy foil cover 84 bonded at peripheral edge 86 to container sidewall 88. The cover in tightly stretched on the container so that the downward stroke of teeth 68 and head 70 will tear the cover and release the contents of the container.

Figure 11:
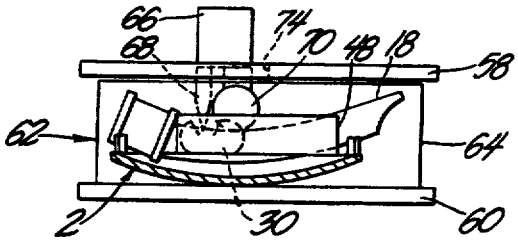

In FIG. 11, the down stroke of tool 66 causes head 70 to bend illuminator body 18 to break an ampule (not shown) therein, thereby beginning a light emitting chemical reaction. At the same time, teeth 68 puncture lid 76 and pierce the canister, which is element 28 in FIG. 3 or element 46 in FIG. 7. Also, wall section 36 of the lane marker's base 4 will be pierced at plug 38, but plug 38 will reseal section 36 once the teeth have been retracted. After teeth 66 pierce wall section 36, they break capsule 30 so that the foam formation reagents come into contact with each other. Immediately thereafter, tool 66 retracts upward, then container 62 and marker 2 leave the platens as in FIG. 12, and finally marker 2 deploys by dropping to the ground with dish 28 oriented downward.

Figure 12:
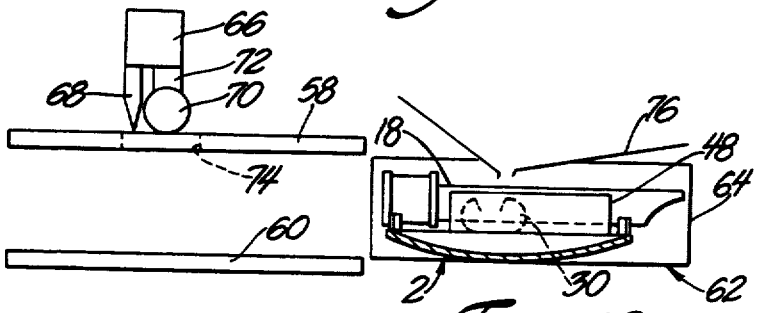
Figure 16:
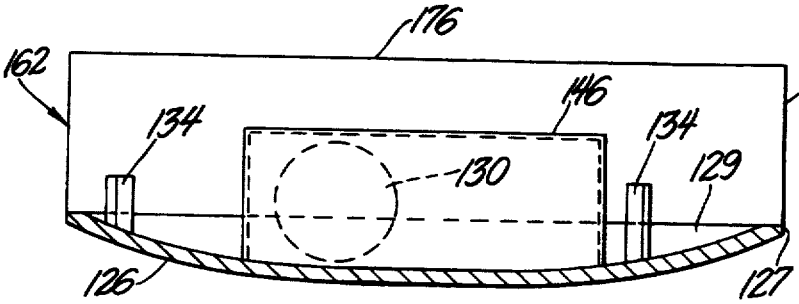
FIG. 16 shows an optional combination of the canister and the base of the lane marker.

FIG. 16 shows an alternate container 162 that can replace container 62 in FIGS. 10 through 12. Container 162 has a peripheral sidewall 164 similar to sidewall 64 and has a lid 176 similar to lid 76. The floor or bottom panel 65 of container is replaced by an enlarged dish 126, which is analogous to dish 26 in FIGS. 3 and 7, and which has outer edge 127 joined to wall 164. Setting on dish 126 are cradles 134 similar to cradles 34 and canister 146 similar to canister 46, and inside canister 146 is capsule 130 comparable to capsule 30. The space 129 in dish adjacent canister 146 can optionally be filled by ballast material such as the material of ballast 32 in FIG. 3.

The self-righting capability of my lane marker will be discussed with reference to FIGS. 18 through 21. In FIG. 19, lane marker 2 is shown tipped on its side upon ground surface 90 after deployment and after foam formation has occurred. A pivot point 92 is at the point of contact of ring 10 with surface 90. Due to the high density and mass of dish 26 and optional ballast 32 (FIG. 3) and due to the low density of the foam that fills the various tubular members of the marker, the gravitational center of marker 2 will be at point 94 within dish 26. Lane marker 2 will tip counterclockwise from the FIG. 19 position to the FIG. 19A position, where the lane marker rests both on pivot point 92 and fulcrum point 96. The gravitational center's position is such that lane marker 2 will continue to tip counterclockwise until the marker it is upright and resting on dish 26.

Figure 18:
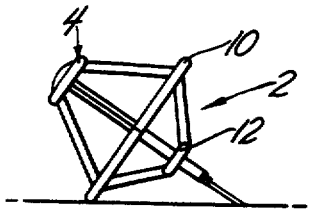
FIGS. 18, 19 and 19A are front elevational views of lane markers tipped sideways on the ground.
Figure 19:
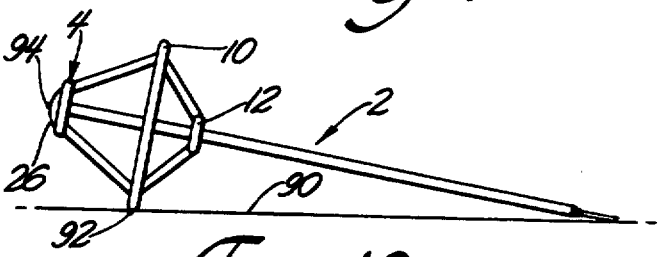
Figure 19A:
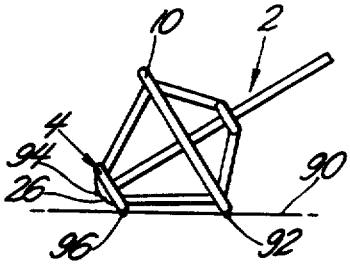
Figure 20:
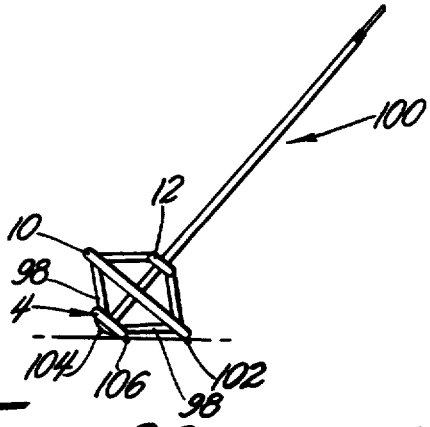
FIGS. 20 and 21 are front elevational views of a final embodiment of my lane marker.
Figure 21:
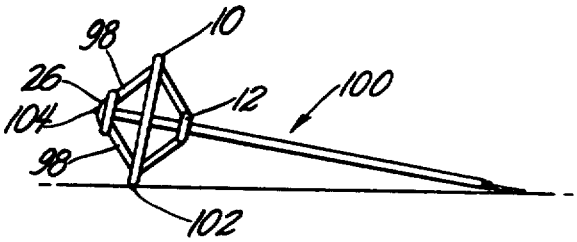

The same self-righting action as just described will also occur for the FIG. 6 embodiment of the lane marker, which embodiment is shown tipped over on its side in FIG. 18. Self righting occurs as well for embodiment 100 of the lane marker in FIGS. 20 and 21, embodiment 100 being the same as FIG. 1 except for tubes 98 that are shorter than tubes 6 in FIG. 1. In FIGS. 20 and 21, the lane marker first pivots counterclockwise on point 102, and then continues pivoting in the same direction about point 106 (FIG. 20) because of the location of gravitational center 104.

I wish it to be understood that I do not desire to be limited to the exact details of construction or method shown herein since obvious modifications will occur to those skilled in the relevant arts without departing from the spirit and scope of the following claims.

I claim:

1. An automatically deployable device for marking territory, comprising:

a base;

a ground engagement member forming part of the base;

a canister on the ground engagement member;

one or more foam formation agents within the canister;

cradles on the ground engagement member;

a tube frame assembly communicated to the canister, the tube frame assembly lighter than the ground engagement member;

illuminator means for generating light, the illuminator means connected to the frame assembly and lying upon the cradles during a pre-deployment configuration of the marker;

wherein the frame assembly has a compact condition in which at least a part of the frame assembly folds upon a portion of the base, and the frame assembly has an expanded condition in which the frame assembly is filled with rigidifying foam and the frame assembly raises the illuminator means.

2. The marker of claim 1 wherein the frame assembly in the expanded condition comprises:

a central axis extending from the base;

a tubular ring disposed about the central axis;

lower tubes connecting the base to the ring, the lower tubes diverging from the base toward the ring;

a manifold on the central axis;

upper tubes connecting the ring to the manifold, the upper tubes converging from the ring toward the manifold.

3. The marker of claim 2 wherein the frame assembly comprises an upright tubular mast extending from the manifold along the central axis.

4. The marker of claim 3 wherein the frame assembly includes a central strut between the base and the manifold.

5. The marker of claim 1 wherein:

opposed walls of one or more of the canisters define an elongate gap on the base; and at least a portion of the frame assembly in the compact condition lies in the gap.

6. The marker of claim 1 further comprising:

a foldably flexible inelastic base wall forming part of the base;

a periphery of the flexible base wall mated to the ground engagement member so as to form a sealed compartment containing the canister.

7. The marker of claim 6 further comprising:

a puncturable zone of a peripheral wall of the canister;

a pierce receiving zone of the base wall disposed over the puncturable zone of the peripheral wall at least during the compact condition of the frame assembly;

resealer means at the pierce receiving zone for post-puncture reclosing of the pierce receiving zone.

8. The marker of claim 1 wherein a center of gravity of the marker is within the ground engagement member.

9. The marker of claim 1 wherein the frame assembly in the expanded condition comprises:

an exterior of the frame assembly formed by a flexible inelastic cutaneous wall;

an interior of the frame assembly formed by a continuous body of the foam.

10. The marker of claim 9 further comprising:

a flexible inelastic base wall forming part of the base;

a periphery of the flexible base wall mated to the ground engagement member so as to form a sealed compartment containing the canister;

a second body of the foam occupying the sealed container, the second body integral with the continuous body.

11. A territory marking device, comprising:

a base;

a ground engagement member forming part of the base;

a canister on the ground engagement member;

a foldably flexible inelastic base wall forming part of the base;

a periphery of the flexible base wall mated to the ground engagement member so as to form a sealed compartment containing the canister;

one or more foam formation agents within the canister;

a tube frame assembly communicated to the canister;

wherein the frame assembly has a compact condition in which at least a part of the frame assembly folds upon a portion of the base, and the frame assembly has an expanded condition in which the frame assembly is filled with foam.

12. The marker of claim 11 wherein the marker during the expanded condition of the frame assembly comprises:

exterior peripheral portions of the frame assembly and base formed by contiguous flexible inelastic cutaneous walls;

interiors of the frame assembly and a part of the base formed by a single, continuous body of the foam.

13. The marker of claim 12 wherein:

opposed walls of one or more of the canisters define an elongate gap on the base; and at least a portion of the frame assembly in the compact condition lies in the gap.

14. The marker of claim 13 further comprising:

a puncturable zone of a peripheral wall of the canister;

a pierce receiving zone of the base wall, the pierce receiving zone disposed over the puncturable zone of the peripheral wall at least during the compact condition of the frame assembly;

resealer means at the pierce receiving zone for post-puncture reclosing of the pierce receiving zone.

* * * * *